US006995635B2

(12) United States Patent
Wung et al.

(10) Patent No.: US 6,995,635 B2
(45) Date of Patent: Feb. 7, 2006

(54) MICROSTRIP LINE PARALLEL-COUPLED-RESONATOR FILTER WITH OPEN-AND-SHORT END

(75) Inventors: Hong-long Wung, Yunlin (TW); Chi-Yang Chang, Taipei (TW); Dow-Chih Niu, Taipei (TW)

(73) Assignee: Chung Shan Institute of Science and Technology, Taoyuan (TW)

( * ) Notice: Subject to any disclaimer, the term of this patent is extended or adjusted under 35 U.S.C. 154(b) by 0 days.

(21) Appl. No.: 10/708,353

(22) Filed: Feb. 26, 2004

(65) Prior Publication Data

US 2005/0190016 A1 Sep. 1, 2005

(51) Int. Cl.
*H01P 1/203* (2006.01)

(52) U.S. Cl. ..... 333/204; 333/219

(58) Field of Classification Search ..... 333/203–205, 333/219

See application file for complete search history.

(56) References Cited

U.S. PATENT DOCUMENTS

| | | | | |
|---|---|---|---|---|
| 6,559,741 | B2 * | 5/2003 | Takeda | 333/204 |
| 2003/0085780 | A1 * | 5/2003 | Wang | 333/204 |
| 2004/0251991 | A1 * | 12/2004 | Rahman et al. | 333/205 |

FOREIGN PATENT DOCUMENTS

| | | | |
|---|---|---|---|
| JP | 63219202 A | * | 9/1988 |
| JP | 02206201 A | * | 8/1990 |
| JP | 03049301 A | * | 3/1991 |

* cited by examiner

*Primary Examiner*—Seungsook Ham
(74) *Attorney, Agent, or Firm*—Jianq Chyun IP Office

(57) ABSTRACT

The parallel-coupled-resonator coupled line filter with open-and-short end, comprises an input port for receiving an input signal; a bent first resonator and a bent third resonator where their both ends are open circuited; a second resonator whose both ends are shorted to ground; and an output port for outputting signal. Wherein, designing cross coupling between the third resonator and the first resonator to obtain a steep frequency response and reduce the interference of the image signal.

5 Claims, 4 Drawing Sheets

MICROSTRIP LINE PARALLEL-COUPLED-RESONATOR FILTER WITH OPEN-AND-SHORT END

BACKGROUND OF INVENTION

1. Field of Invention

The present invention generally relates to a parallel coupled resonator filter with open-and-short end and bent resonator to improve the stop-band attenuation rate performance.

2. Description of Related Art

Because of the progress of communication techniques, wireless communication devices are becoming widely accepted now. In various wireless communication system, the band used for transmitting frequency is from the traditional radio frequency (RF) further upgraded to the microwave band. However, regardless of which band is used, eliminating spurious signal is the key point of the performance of wireless communication systems. Therefore, the characteristics of filter become one of major factors of the whole wireless communication system.

Filters used in microwave bands can be made by the different kind of transmission lines, such as microstrip line and CPWline, etc. Generally, resonators are realized by half wavelength of transmission lines with open or short end. The microwave signal is coupled between the resonators. The filter is designed by adjusting coupling coefficients between resonators.

Referring to FIG. 1, it schematically shows a diagram of a conventional three-resonators microstrip line parallel-coupled-resonator filter used in the microwave band. As shown in the diagram, the filter comprises an input port 110, a first resonator 120, a second resonator 130, a third resonator 140, and an output port 150. First, the input port 110 receives an input signal. Then, the signal passes from resonator 120 to resonator 140. Finally, the signal is transferred to output port 150.

The disadvantages of the microstrip coupled line filter are as follows: 1. The frequency response of the conventional microstrip line parallel-coupled-resonator filter is shown in FIG. 2, the stop band attenuation rate is not fast enough to eliminate image signal. 2. In order to obtain a faster stop band attenuation rate, the number of the resonators used has to be increased. However, when the number of the resonators increases, the size of the whole filter will occupy too much space to meet the compact size requirement of system.

SUMMARY OF INVENTION

To solve the problem mentioned above, the present invention provides a microstrip line parallel-coupled-resonator filter with open-and-short end can achieve fast attenuation of the stop band to eliminate the image signal . At the same time, keep the compact size of filter.

In order to achieve the object mentioned above and others, the present invention provides a microstrip line parallel-coupled-resonator filter with open-and-short end. The filter comprises an input port, a first resonator, a second resonator, a third resonator, and an output port. The input port receives an input signal, the first resonator is a bent resonator coupled signal from the input port. The second resonator is a bent resonator whose both ends are shorted to ground and coupled signal form the first resonator. The third resonator is a bent resonator coupled signal from the second resonator. The output port couples signal form the third resonator and outputs signal. The cross coupling between first resonator and third resonator generate transmission zero, it cause steeper shirt properties than conventional filter in the lower stop-band. The cross coupling between first resonator and third resonator can be designed byte gap, so the dip of the rejection can be adjusted to the image frequency to eliminate the interference signal.

In one embodiment, the input port and the output port of the filter are in the same direction, and there is a weak cross coupling between them. Therefore, it can generate another transmission zero to improve the upper stop-band attenuation rate.

In one embodiment, the input port, first resonator, the second resonator, the third resonator, and the output port of the microstrip line parallel-coupled-resonator filter with open-and-short end are manufactured on a substrate. Wherein, the dielectric constant of the substrate is 3.38, and the thickness of the substrate is 20 mils. The grounding of both ends of the second resonator is achieved by using the method of coating metal on the through hole or by using the method of inserting the grounded pole.

In one embodiment, the length of the first resonator and the third resonator is 612 mils, and the length of the second resonator is 636 mils, and all the couple distance is 4 mils.

BRIEF DESCRIPTION OF DRAWINGS

The accompanying drawings are included to provide a further understanding of the invention, and are incorporated in and constitute a part of this specification. The drawings illustrate embodiments of the invention, and together with the description, serve to explain the principles of the invention.

DETAILED DESCRIPTION

Figure 3:
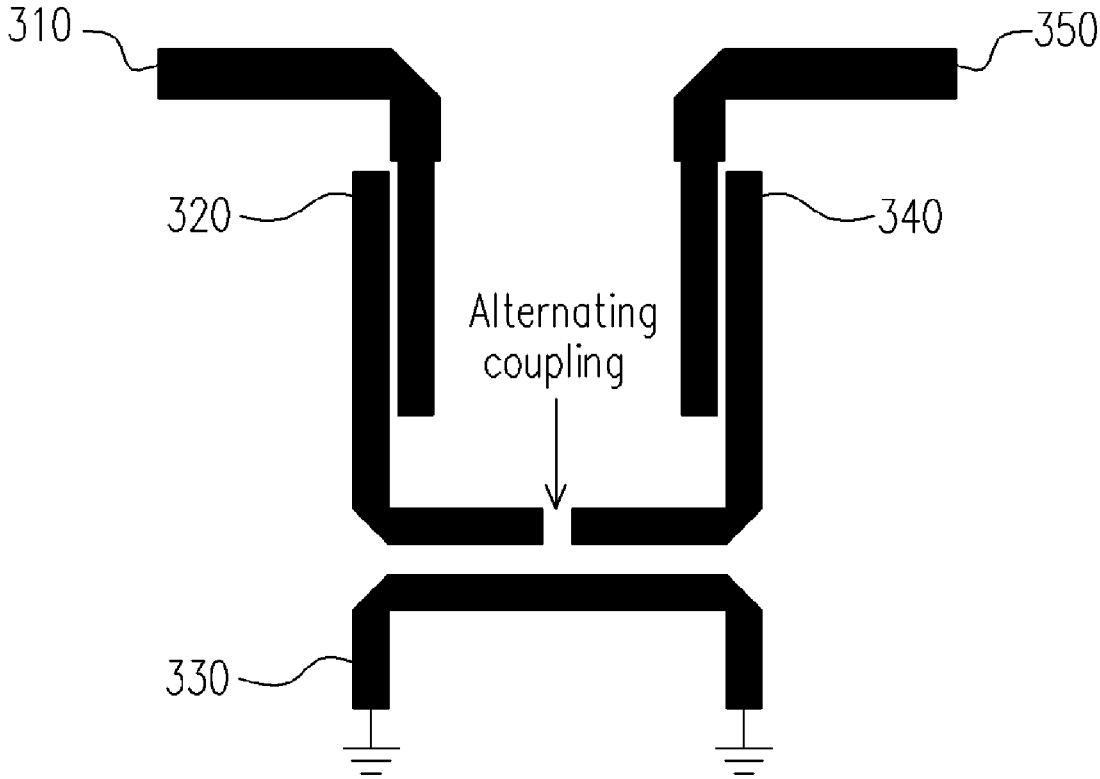
FIG. 3 schematically shows a diagram of a microstrip line parallel-coupled-resonator flier with open-and-short end of the preferred embodiment according to the present invention.

Referring to FIG. 3, it schematically shows a diagram of a parallel-coupled-resonator filter with open-and-short end of the preferred embodiment according to the present invention. As shown in FIG. 3, besides having the same input port 310 that inputs signal and the output port 350 that output the signal after it is filtered, the first resonator 320, the second resonator 330, and the third resonator 340 have been respectively replaced with the bent resonators and the second resonator whose both ends are shorted to ground, and the cross coupling between first resonator and third resonator is designed in filter.

As shown in the diagram, the first resonator 320 and the third resonator 340 are the bent resonators with both ends open circuited, and the second resonator 330 is a bent resonator whose both ends are shorted to ground. Wherein, the first resonator 320 couples to the input port 310, the second resonator 330 couples to the first resonator 320, and the third resonator 340 couples to the second resonator 330.

There is a capacitive gap cross coupling between the first resonator 320 and the third resonator 340. With the cross coupling existed between the first resonator 320 and the third resonator 340, and both ends of the second resonator 350 are shorted to ground. The transmission zero can be generated in lower stop-band and achieve a steep filter rejection response.

For infradyne receiver system, the transmission zero can be designed around the image frequency, so that the image signal can be significantly attenuated and the interference due to the image signal onto the receiver system can be reduced. For example, when the RF frequency is 5.8 GHz, and the local frequency is 5.1 GHz, the image frequency should be at 4.4 GHz (2*LO-RF). The transmission zero can be designed at 4.4 GHz to eliminate the interference due to the image signal. By changing the cross coupling gap distance between the first resonator 320 and the third resonator 340 as shown in FIG. 3, the dip of rejection can be adjusted around the image frequency (4.4 GHz).

Further, since the first resonator 320 and the third resonator 340 of the parallel-coupled-resonator coupled line filter with open-and-short end of FIG. 3 are orthogonally bent, the input port 310 and the output port 350 can be arranged in the same direction to generate a weak cross coupling between input and output. It can generate another transmission zero in the upper stop-band to improve the steepness of filters upper skirt.

To verify the frequency response of the filter, herein the input port 310, the first resonator 320, the second resonator 330, the third resonator 340, and the output port 350 are manufactured on a substrate having a dielectric constant of 3.38 and a thickness of 20 mils. The general circuit board manufacturing method is used as its manufacturing method, in other words, photographing, chemical manufacturing process (including adding photoresist, exposure, etching) have been applied. Further, the grounding of both ends of the second resonator 330 is achieved by using the method of coating metal on the through hole or by using the method of inserting the grounded pole. Wherein, since the central frequency of the selected open short terminated coupled line filter is 5.8 GHz, the length of the selected first resonator 320 and the third resonator 340 is 612 mils, the length of the second resonator 330 is 636 mils, and all the coupling distance between the resonators is 4 mils for adapting to the required central frequency.

Figure 1:
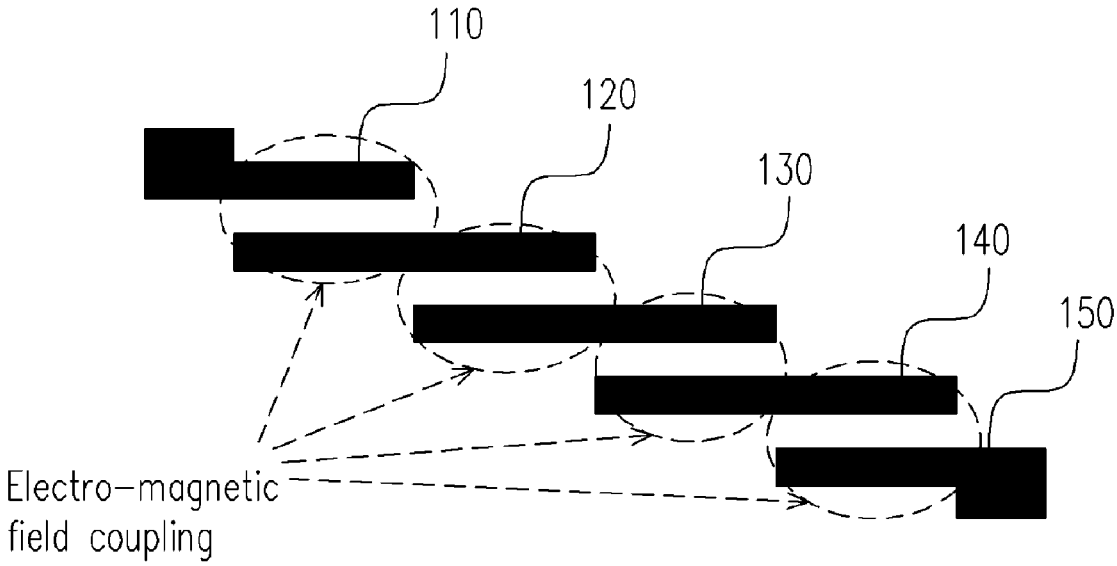
FIG. 1 (PRIOR ART)
FIG. 1 schematically shows a diagram of a conventional three-resonator conventional microstrip line parallel-coupled-resonator filter that is suitable for the microwave band.
Figure 2:
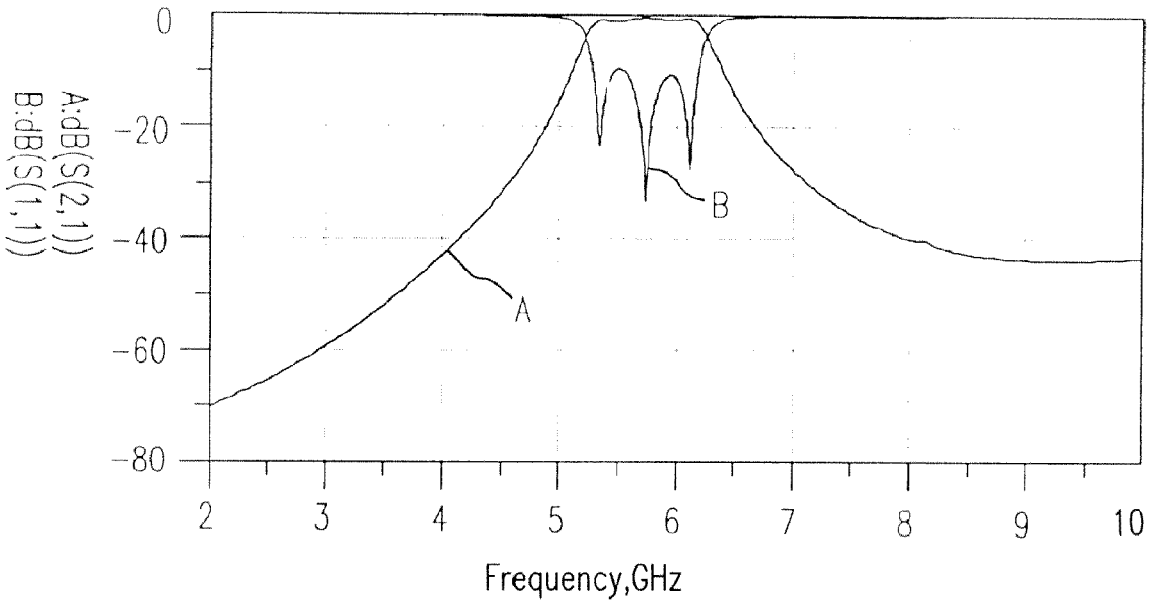
FIG. 2 (PRIOR ART)
FIG. 2 schematically shows a frequency response curves of the conventional microstrip line parallel-coupled-resonator filter of FIG. 1.
Figure 4:
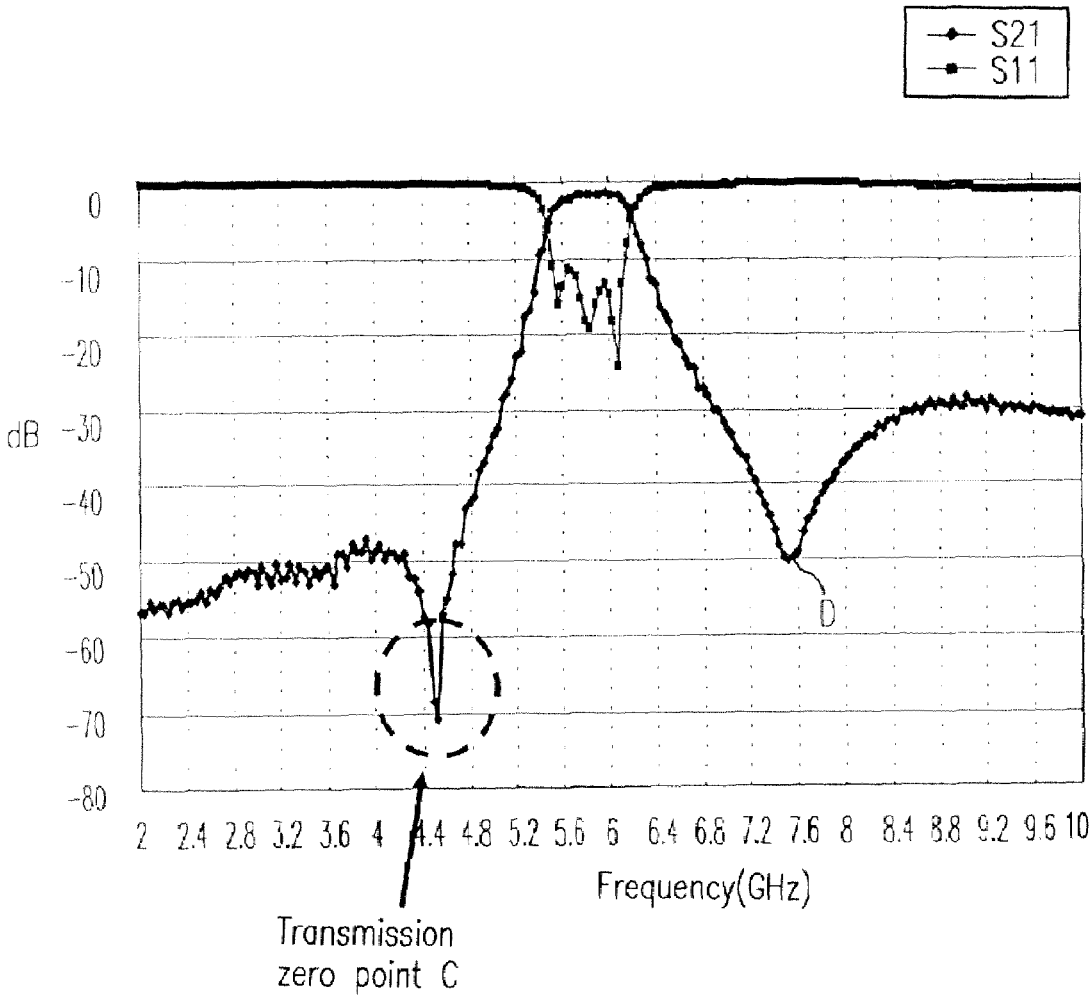
FIG. 4 schematically shows a frequency response curves of a microstrip line parallel-coupled-resonator filter with open-and-short end of FIG. 3.

Referring to FIG. 4, it schematically shows the frequency response curves measured from the manufactured filter as shown in the diagram. The central frequency is 5.8 GHz, The pass-band is about 5.5~6.2 GHz. The insertion loss is about 1.5~2 dB. The return loss is greater than 10 dB and the image rejection capability in lower stop-band (point C) is around −70 dB. Further, at point D, the rejection of upper stop-band is around −50 dB. The rejection of filter is much better than the conventional microstrip line parallel-coupled-resonator as show in FIG. 2.

Therefore, following advantages of can be achieved: 1. By bending the resonator, the length of whole filter can be shortened. 2. The cross coupling between the first resonator and the third resonator, and both ends of the second resonator shorted to ground can be applied to generate the transmission zero in the lower stop-band. The transmission zero also could be designed at the frequency where the image signal appears, so that the interference near the image frequencies can be reduced largely. 3. The input port and output port can be arranged in the same direction to generate a weak cross coupling. Therefore, it can generate a similar transmission zero in the upper stop-band to improve the filter rejection.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A microstrip line parallel-coupled-resonator coupled line filter with open-and-short end, comprising:

an input port, used to receive an input signal;

a first resonator, wherein the first resonator is a bent resonator and is coupled to the input port;

a second resonator, wherein the second resonator is a resonator whose both ends are shorted to ground, and coupled to the first resonator;

a third resonator, wherein the third resonator is a bent resonator, and is coupled to the second resonator and cross coupling exists through a gap between the first resonator and the third resonator, wherein the gap is used to design lower stop-band transmission zero; and an output terminal, coupled to the third resonator to output signal.

2. The microstrip line parallel-coupled-resonator coupled line filter with open-and-short end of claim 1, wherein a portion of the input port and a portion of the output port are facing in a same direction, resulting in a weak cross coupling, wherein the distance between the portion of the input port and the portion of the output port is used to design upper stop-band transmission zero.

3. The microstrip line parallel-coupled-resonator coupled line filter with open-and-short end of claim 1, wherein the input port, the first resonator, the second resonator, the third resonator, and the output port are manufactured on a substrate.

4. The microstrip line parallel-coupled-resonator coupled line filter with open-and-short end of claim 3, wherein the dielectric constant of the substrate is 3.38, and the thickness of the substrate is 20 mils.

5. The microstrip line parallel-coupled-resonator coupled line filter with open-and-short end of claim 3, wherein the length of the first resonator and the third resonator is 612 mils, the length of the second resonator is 636 mils, and the couple distance between the resonators is 4 mils.

* * * * *